United States Patent [19]

Inaba et al.

[11] Patent Number: 4,585,403

[45] Date of Patent: Apr. 29, 1986

[54] SCROLL DEVICE WITH ECCENTRICITY ADJUSTING BEARING

[75] Inventors: Tsutomu Inaba; Toshiyuki Nakamura; Tadashi Kimura, all of Wakayama, Japan

[73] Assignee: Mitsubishi Denki Kabushiki Kaisha, Tokyo, Japan

[21] Appl. No.: 586,607

[22] Filed: Mar. 6, 1984

[51] Int. Cl.[4] ..... F01C 1/04; F01C 21/04

[52] U.S. Cl. ..... 418/55; 418/94

[58] Field of Search ..... 418/55, 59

[56] References Cited

U.S. PATENT DOCUMENTS

| | | | |
|---|---|---|---|
| 1,906,141 | 4/1933 | Ekelof | 418/59 |
| 4,065,279 | 12/1977 | McCullough | 418/55 |
| 4,396,364 | 8/1983 | Tojo et al. | 418/55 |
| 4,415,318 | 11/1983 | Butterworth et al. | 418/55 |

FOREIGN PATENT DOCUMENTS

| | | | |
|---|---|---|---|
| 0010930 | 5/1980 | European Pat. Off. | 418/55 |
| 57-24486 | 2/1982 | Japan | 418/55 |

*Primary Examiner*—John J. Vrablik
*Assistant Examiner*—Theodore W. Olds
*Attorney, Agent, or Firm*—Sughrue, Mion, Zinn, Macpeak and Seas

[57] ABSTRACT

A scroll-type pumping apparatus comprising a stationary scroll 1, an orbiting scroll 2 attached to an orbiting scroll shaft 4, and a crankshaft 14. An eccentric hole is formed in the end of the crankshaft and an eccentric bearing 26 rotates within this eccentric hole. The eccentric bearing has a central aperture eccentric to the bearing's outer circumference in which the orbiting scroll shaft is placed and freely rotates.

36 Claims, 15 Drawing Figures

SCROLL DEVICE WITH ECCENTRICITY ADJUSTING BEARING

BACKGROUND OF THE INVENTION

This invention relates to a scroll type positive fluid displacement apparatus for compressing, expanding or pumping fluids.

The principles of operation of a scroll apparatus will be explained with reference to FIG. 1, which shows a stationary involute or spiral-shaped scroll 1 and an orbiting scroll 2 of like shape but displaced and rotated 180°. The orbiting scroll 2 performs orbital motion about a point without rotation. Thus, a side of the orbiting scroll moves so as to always remain in a parallel position. Compression pockets 3 and 5 are formed in the space between the stationary and orbiting scroll members whose volumes are decreased (assuming compressing operation) during orbiting about a central point O as shown in the sequence of FIGS. 1(a)-1(d) until they merge into a single, similarly, shrinking central outlet pocket 8'. At the same time, new inlet pockets are formed as shown in FIG. 1(c) at 3, 5, which progressively shrink or are compressed.

The U.S. Pat. Nos. 3,884,599 and 4,065,279 disclose scroll type positive fluid displacement apparatus to ensure axial and radial sealing of the scroll assembly.

The U.S. Pat. No. 1,906,142 shows an exteriorly cylindrical boss for permitting the scrolls to move a little in a radial direction on a crank pin.

SUMMARY OF THE INVENTION

An object of the present invention is thus to provide a new scroll type positive fluid displacement apparatus which is able to seal a compression pocket in a radial direction and to restrain a driving shaft from producing a moment which would incline the driving shaft.

The object is accomplished by providing a new scroll type apparatus comprising a stationary scroll member having a spiral-shaped wrap, an orbiting scroll member having a spiral-shaped wrap of the same shape as that of the spiral wrap of the stationary scroll member but having a rotated orientation, a compression pocket formed by a space between the stationary scroll member and the orbiting scroll member, a driving shaft having a first eccentric hole formed at its end with a predetermined eccentricity, causing the orbiting scroll member to orbit, an eccentric bushing rotatably mounted in the first eccentric hole, having a second eccentric hole formed in the eccentric bushing with a predetermined eccentricity, a pin formed on a surface of the orbiting scroll member on an opposite side to the spiral-shaped wrap of the orbiting scroll member having a common axis with that of the orbiting scroll member and mounted in the second eccentric hole, a bearing mounted within the region radially enclosing the bushing, for radially supporting the driving shaft, supporting member supporting the bearing, and a rotation preventing means for allowing orbital motion without rotation of the orbiting scroll member and the supporting member.

DETAILED DESCRIPTION OF THE PREFERRED EMBODIMENT

Figure 2:
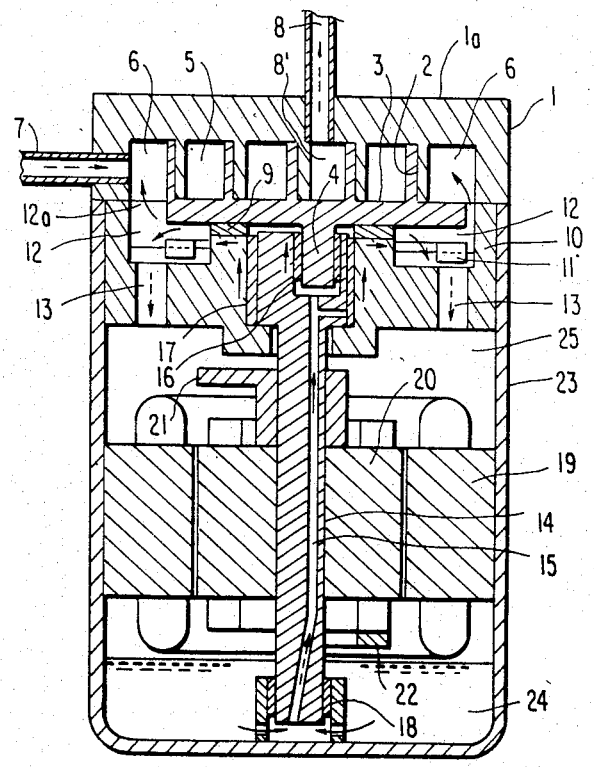
FIG. 2 PRIOR ART
FIG. 2 is a longitudinal sectional view of a conventional scroll type compressor.

FIG. 2 shows a scroll compressor, which has been developed in the corporation to which this application is assigned, wherein a thrust bearing 9 supports the back of a base plate 3 of the orbiting scroll member 2. A space 12 is formed for an Oldham coupling between the support member 10 for the bearing and the base plate 3, such support member being bolted or the like to the stationary scroll member 1. The Oldham coupling is a well-known mechanism for inducing orbital motion while preventing rotation. An oil passage 13 communicates the space 12 with the interior space 25 formed between the said supporting member and the motor, and an oil hole 15 is formed eccentrically in a driving shaft 14 supported at its upper and lower ends by bearings 17, 18. When a stator 19 of a motor is energized, the driving shaft 14 is rotated. The orbiting scroll member 2 which is guided by an Oldham coupling member 11 moves in a orbiting motion in accordance with the rotation of the driving shaft 14.

Reserved oil 24 within a bottom of a sealed or airtight shell 23 is sucked upwardly into the oil hole 15 by a centrifugal force due to the rotation of the driving shaft 14, and then the sucked oil is supplied to the bearings 17, 26, thrust bearing 9, and to the Oldhams coupling 11 and the space 12. The supplied oil in the space 12 flows downwardly through the oil passage 13 into the space 25, and then falls down into the bottom of the shell 23.

Figure 1:
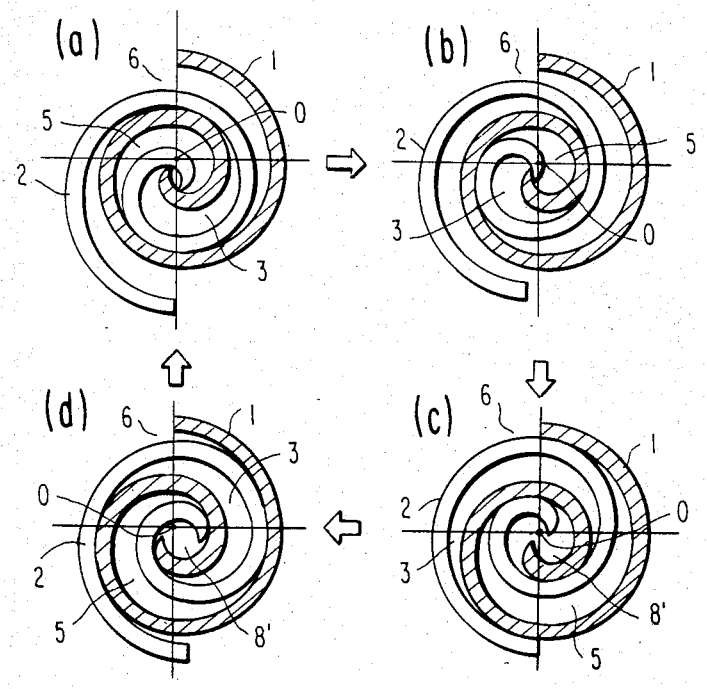
FIGS. 1(a), (b), (c) and (d) are diagrams explaining the principle of operation of a scroll pump.

The base plate 3 has a pin 4 at the center of the base plate 3. The pin 4 is supported by an inner bearing 16 mounted in a hole positioned eccentrically with respect to the axis of the driving shaft 14. The orbiting scroll 2 as a result accomplishes the compressing process shown in FIGS. 1*a, b, c* and *d*.

After the gaseous fluid is taken from an intake tube 7 into the compression pockets 3 and 5 through inlet pockets 6 located at circumferential edges of the orbiting scroll member 2, the gaseous fluid is exhausted through the outlet 8, through an outlet pocket 8', after the pockets 3 and 5 have been shifted to the interior of the scroll members 1 and 2.

In the construction shown in FIG. 2, the entire compressor may vibrate because of the unbalanced forces from the orbiting movement of the orbiting scroll member 2 as it follows the rotation of the driving shaft 14. To remedy this problem, a first counter-weight 21 is placed eccentrically on the driving shaft 14, and a second counter-weight 22 placed eccentrically on a rotor 20 of the motor which statically and dynamically balance the driving shaft 14 so that the compressor can operate without vibration.

Figure 3B:
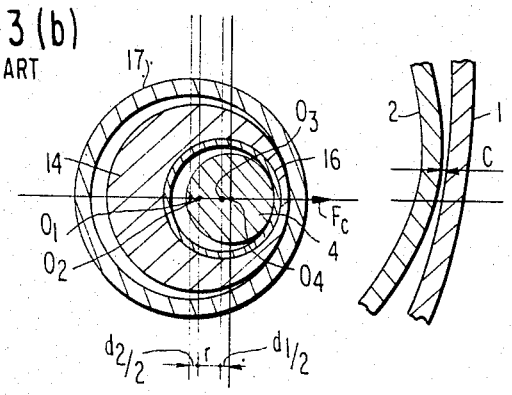
FIG. 3(b) PRIOR ART
FIG. 3(b) is a cross-sectional view of the portion of FIG. 3(a) along the twisted cross-sectional line IIIb—IIIb.
Figure 3A:
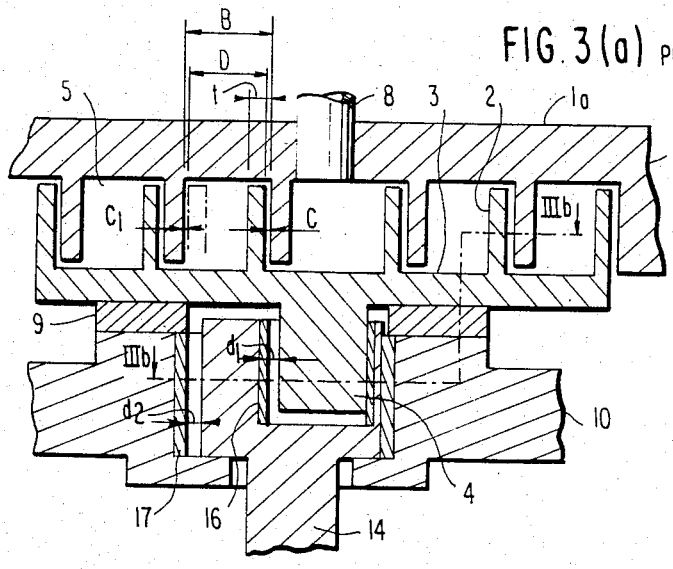
FIG. 3(a) PRIOR ART
FIG. 3(a) is an enlarged radial cross-sectional view of a portion of FIG. 2.

In FIG. 3(a) is shown an enlarged side cross-section of a portion of FIG. 2 including the stationary scroll 1, the orbiting scroll 2, and the driving shaft 14. In FIG. 3(b) is shown a top cross-section of a portion of FIG. 3(a) along the twisted cross-sectional line IIIb—IIIb of FIG. 3(a), under the condition that the orbiting scroll pin 4 is pressed to the bearing 16 by only the centrifugal force $F_c$ of the orbiting scroll 2 and its base plate 3, without accounting for the effect of the force resulting from the compressed gas between the elements. A point $O_1$ represents the center of the main bearing 17; a point $O_2$, the center of the driving shaft 14; a point $O_3$, the center of the inner bearing 16; and a point $O_4$, the center of the orbiting scroll shaft 4.

The inner bearing 16 and the driving shaft 14 are separated by an eccentricity r. The inner diameter of the inner bearing 16 is greater than the outer diameter of the orbiting scroll pin 4 by a bearing clearance $d_1$. Likewise, the inner diameter of the main bearing 17 is greater than the outer diameter of the crankshaft 14 by a bearing clearance $d_2$. The wrap of the stationary scroll 1 is formed of the vane-like continuous protrusion in a spiral shape and the spiral has a radial pitch of a distance B. A wrap of the orbiting scroll 2 orbits through a horizontal space, defined by actual orbiting diameter D. The wrap of the orbiting scroll member 2 is of thickness t. The wrap of the stationary scroll 1 does not contact the wrap of the orbiting scroll 2 but is separated by gaps C and $C_1$ in the radial direction. In practice, however, C is equal to $C_1$.

In the conventional scroll type compressor described above, the actual orbiting diameter D may be expressed as $$D = 2(r + d_1/2 + d_2/2) + t = 2r + t + d_1 + d_2. \quad (1)$$

The gap between the wraps of the stationary scroll 1 and the orbiting scroll 2, which is $C=(B-D)/2$, may be alternately expressed by using equation (1) as $$C = [B - (2r + t + d_1 + d_2)]/2 = [(B - 2r - t) - (d_1 + d_2)]/2. \quad (2)$$

Generally, since the first term $(B-2r-t)$ in equation (2) representing the radial clearance is larger than the second term $(d_1+d_2)$, the sum of the bearing clearances, the gap C always exists.

Figure 4:
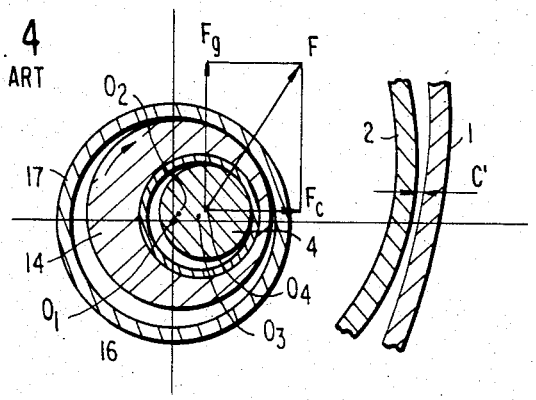
FIG. 4 PRIOR ART
FIG. 4 is a cross-sectional view corresponding to FIG. 3(b) additionally accounting for load force.

In practical operation of the scroll compressor, there is a load force $F_g$ on the orbiting scroll pin 4 resulting from the compression of the gas. The load force $F_g$ occurs in the direction at a right angle to the centrifugal force $F_c$. The centrifugal force $F_c$ and load force $F_g$ combine to form a resultant force F on the orbiting scroll shaft 4 to press it in the direction shown in FIG. 4.

The radial gap C' between the wraps of the stationary scroll 1 and the orbiting scroll 2 in the presence of the load force $F_g$ is larger than the gap C in the situation in which only the centrifugal force is present.

Because of the radial gaps C and C' existing between the wraps, the side walls of the wraps are not worn by frictional contact between the wraps of the stationary and orbiting scrolls 1 and 2. However, since it is difficult to seal the radial gap at the end of the compression pockets 3 and 5, the gas in these compression pockets 5 can leak back toward lower pressure such as the inlet side or the lower pressure pocket. Such leakage reduces the quantity of gas discharged from the outlet tube 8 and lowers the pumping capacity. This leakage also increases the load on the motor and decreases the compression efficiency because the leakage gas needs to be recompressed. Examples of scroll pumps which attempt to overcome these problems are given in U.S. Pat. Nos. 3,884,599 and 4,065,279.

One possibility of overcoming the above problems is to reduce the difference between the sum of the bearing clearances $(d_1+d_2)$ and the radial clearance $(B-2r-t)$. However, the radial clearance term includes the manufacturing tolerances for each of the dimensions B, r and t, which cannot be precisely controlled, and the bearing clearances $d_1$ and $d_2$ need to be designed large enough in order to always keep $(d_1+d_2)$ larger than $(B-2r-t)$ regardless of the rotational position of the driving shaft.

But, the bearing clearances $d_1$ and $d_2$ should be suitably sized to maintain satisfactory lubrication of the bearings and the bearing clearances should be no larger than the most suitable value. Therefore accurate manufacture is required for the length B between the wraps, the eccentricity r and the thickness t of the wraps in order to satisfy the condition that $(d_1+d_2)$ is always larger than $(B-2r-t)$.

Furthermore, when the center of the stationary scroll 1 deviates for some reason from the center $O_1$ of the main bearing 17, the gaps C and $C_1$ shown in FIG. 3(a) are no longer equal to each other and in the extreme case only one of them has an expected large value. It is thus impossible to make the radial gaps $C_1$ and C approach zero, even if the value of $(d_1+d_2)$ is kept larger than $(B-2r-t)$. To eliminate the above disadvantage, it is therefore additionally required to accurately align the stationary scroll with the center $O_1$ of the main bearing 17.

The present inventors intended to further develop the scroll compressor shown in FIG. 2 into a new scroll compressor that is able to automatically seal the compression pockets in the radial direction regardless of error of machining or assembly.

The inventors learned of an eccentric bushing being described in the U.S. Pat. No. 1,906,142. That is, a crank pin is formed on the end of a driving shaft, an exteriorly cylindrical boss is mounted on the pin, and a hub formed at the center of driven member is rotatably mounted on the boss which is radially displaceable on the crank pin, so that the piston goes in contact with a cylinder wall.

Figure 5:
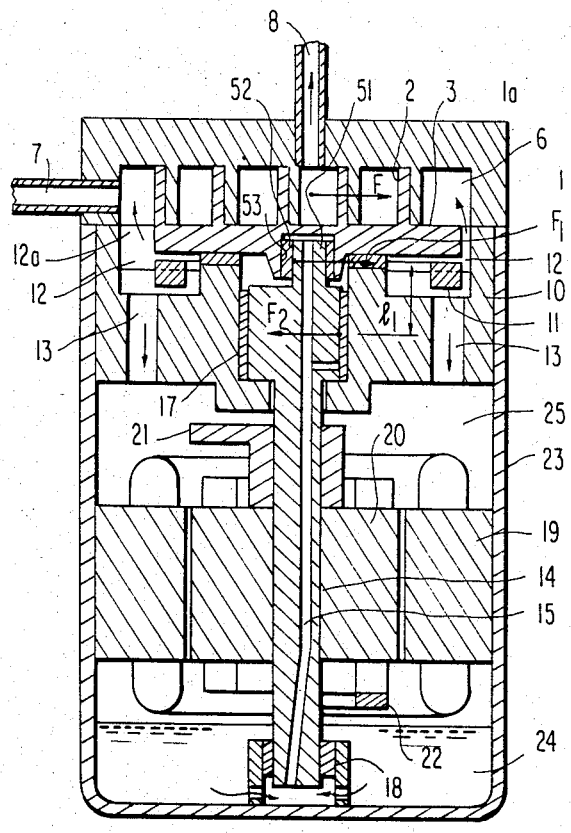
FIG. 5 is a longitudinal sectional view of a scroll type compressor further developed from that shown in FIG. 2.

In FIG. 5, showing a scroll compressor designed according to teachings of the U.S. Pat. No. 1,906,142, a pin 51 is eccentrically formed on the end of the driving shaft 14 supported by the main bearing 17.

An eccentric bushing 52 is rotatably mounted on a pin 51 and in a hole 53 formed at the center of the base plate 3 of the orbiting scroll member 2 in order to permit the orbiting scroll member 2 to move a little in the radial direction around the pin 51.

Figure 6:
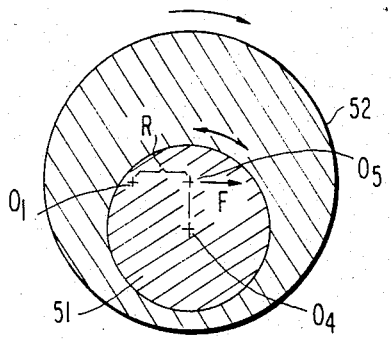
FIG. 6 is a enlarged view of a eccentric bushing and a pin for FIG. 5.

Referring to FIG. 5 and FIG. 6 showing an enlarged view of the eccentric bushing 52 and the pin 51, during the rotation of the driving shaft 14, initially the orbiting scroll member 2 tends to rotate about the pin 51 and the eccentric bushing 52, though it orbits about a point $O_5$ of the center of the hole 53 without any spin because the Oldham coupling member 11 prevents the orbiting scroll member 2 from rotating.

A radius of the revolution of the orbiting scroll member 2 is represented as the distance R between the center $O_1$ of the driving shaft 14 and the center $O_5$ of the hole 53.

The radius R is variable, being able to increase toward the direction of the centrifugal force F and the radius R is defined as the distance $$\left(\frac{D}{2} - t\right)$$

at which the wall of the orbiting scroll 2 goes in contact with the wall of the stationary scroll 1, where P is a pitch of the scroll, t the width of the scroll.

In this type of operation, it was recognized as result of study that reactive force $F_2$ and $F_1$, resulting at about the center of the wall of the main bearing 17 and at about the center of the inner surface of the eccentric bush 52, caused the moment of the driving shaft 14 to incline the shaft 14.

This inclination cannot be avoided in the structure shown in FIG. 5, and the fact that the distance $l_1$ between $F_1$ and $F_2$ is relatively large correspondingly increases the magnitude of the moment. The moment makes continuation of normal operation of on a compressor difficult owing to the resultant inequality of contact of scrolls with each other.

It was also recognized that the eccentric bushing 52 spins on the inner surface of the hole 53 in the orbiting scroll 2, and the pin 51 orbits on the inner surface of the eccentric hole in the eccentric bushing 52.

As a result, the outer surface of the bushing 52 tends to wear because of the rotating movement of the outer surface of the hole of the bushing 52 rotation at the same rotation rate.

In FIGS. 7, 8(a), 8(b), 9(b) showing a scroll compressor according to this invention, a first eccentric hole 16′ is formed in the top of the driving shaft 14. The eccentricity of the hole 16′ is defined by the displacement of its center $O_5$ from the center $O_1$ of the driving shaft 14. An eccentric bushing 26 has a shape such as a hollow cylinder and is placed within the eccentric hole 16′. Its eccentricity is defined by a displacement e between the center $O_5$ of its outer circumference and the center $O_4$ of the inner cylindrical aperture or the second eccentric hole 16″.

The hole 16″ is formed as the inner wall of the eccentric bushing 26 which is entirely made of a suitable bearing material, such as a bearing metal. An orbiting scroll pin 4 is inserted into the eccentric hole 16″ of the bushing 26 so that its center also lies at $O_4$. The eccentricity R of the orbiting scroll pin 4 is the distance between the center $O_1$ of the driving shaft 14 and the center $O_4$ of the orbit scroll pin 4.

Figure 7:
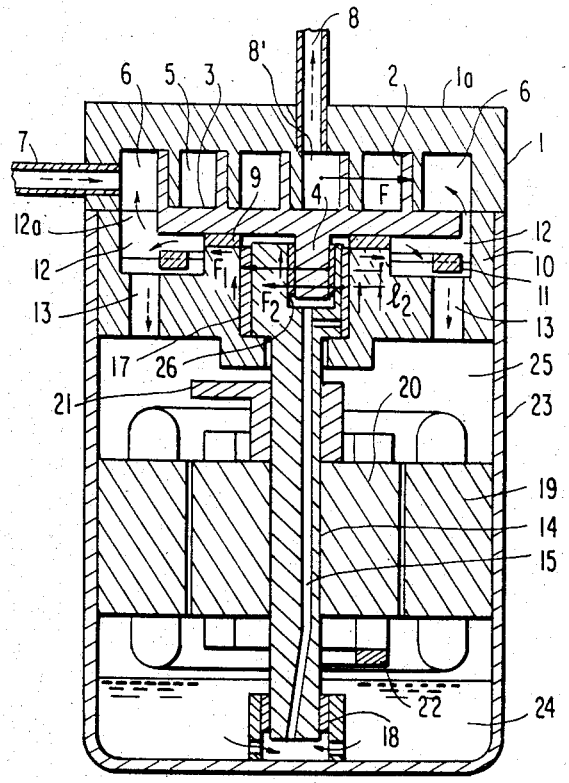
FIG. 7 is a longitudinal sectional view of a scroll type pump according to the present invention.

In the structure shown in FIG. 7, it is easy to restrain the moment caused by $F_1$ and $F_2$, even to be able to make the moment zero by putting lines of action that cancel both $F_1$ and $F_2$, since the main bushing 17 is mounted within the region radially enclosing the bushing 26.

The structure with regard to the eccentric bushing 26 in FIG. 7 is excellent in wear-resistance in comparison with that in FIG. 5, because the pin 4 mounted in the hole 16″ in the bushing 26 rotates in the hole 16″ of which the speed of the surface is lower than that of the outer surface of the bushing 53 when the bushing 53 rotates at the same rotation rate.

Since the other structure and operation of the eccentric bushing 26 of the scroll compressor shown in FIG. 7 are the same as or similar to that of the scroll compressor shown in FIGS. 2 to 5, further description about them will be omitted.

Figure 8A:
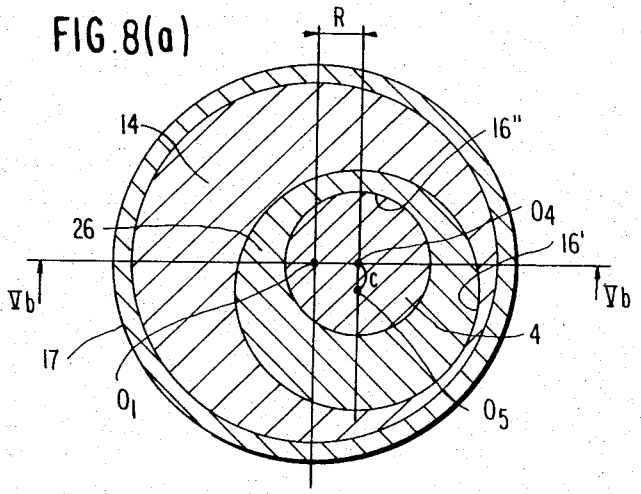
FIG. 8(a) is a radial cross-sectional view of the central portion of a scroll type compressor according to this invention.
Figure 8B:
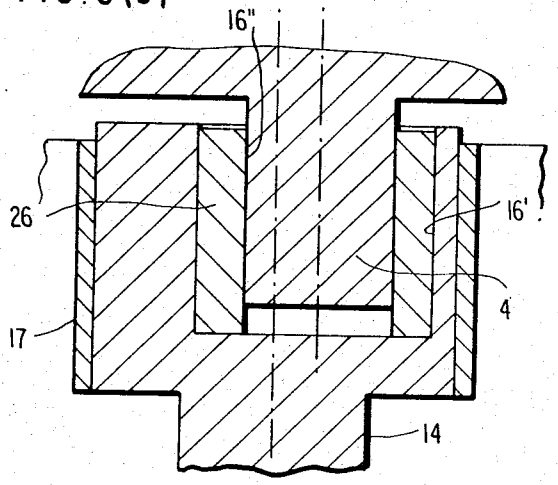
FIG. 8(b) is a longitudinal sectional view of FIG. 8(a) along the cross-sectional line Vb—Vb.

FIGS. 8(a) and (b) and 9(a) and (b) illustrate the simplification of the gaps existing between the eccentric hole and the eccentric bushing 26, or between the hole 16″ and the orbiting scroll pin 4.

In this embodiment of the invention for a scroll type compressor, since the eccentric bushing 26 can freely rotate around its center $O_5$, the center $O_4$ of the hole 16″ of the bushing 26 will also rotate around this center $O_5$ when any rotational force operates on the eccentric bushing 26. Thus the eccentricity R is changed as the result of the rotation of the eccentric bushing 26, as shown in FIGS. 9(a) and (b).

Figure 9A:
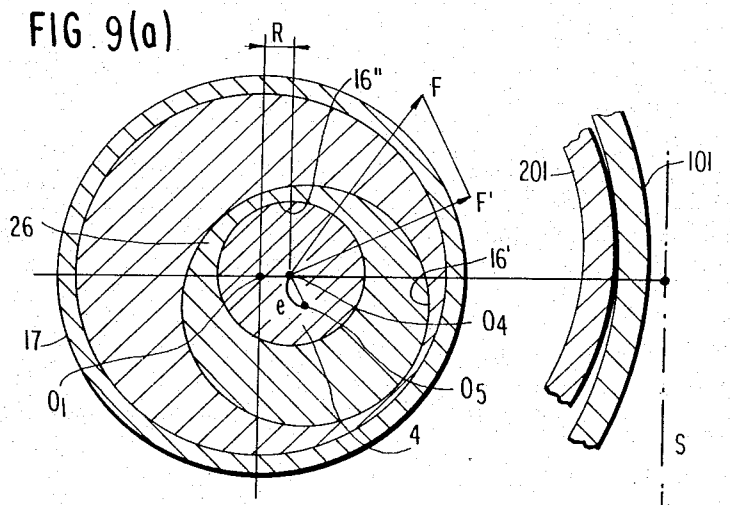
FIGS. 9(a) and (b) are radial cross sectional views corresponding to FIG. 8(a) to explain the principle of this invention.

FIG. 9(a) represents a part of the scroll compressor in which a wrap 101 of the stationary scroll 1 is located after assembling further to the left than a line S which designates the proper designed position of the wrap 101. This deviation could result from inaccurate machining or assembly of the apparatus. The same condition, of course, occurs if a wrap 201 of the orbiting scroll 2 is located too far to the right. Notwithstanding the incorrect alignment of the scrolls 1 and 2 during fabrication, the scrolls are brought into contact by the action of the eccentric bushing 26.

If F denotes the resultant force of the centrifugal force $F_c$ and load $F_g$ resultant from compressing the gas, the eccentric bushing 26 is substantially torqued by the resultant total force F and is made to rotate around its center $O_5$ by the component F′ of the force F at a right angle to the line $O_4$-$O_5$. As a result, the eccentricity R tends to increase but is bounded by the contact of the wraps of the scrolls 1 and 2. The wrap 201 of the orbiting scroll 2 contacts the wrap 101 of the stationary scroll 1 to counterbalance the torquing force F′. As shown in FIG. 9(a), the two wraps 101 and 201 are thus maintained in contact.

Figure 9B:
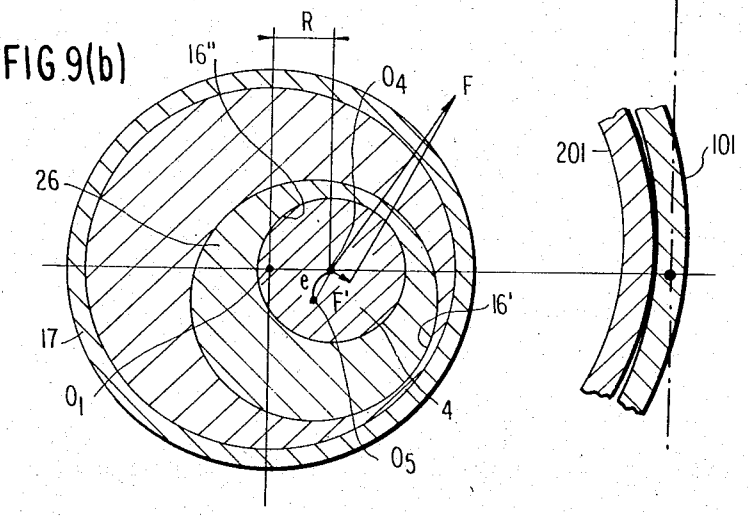

FIG. 9(b) represents the opposite condition that the wrap 101 of the stationary scroll 1 is located to the right of its proper design position. There still exists a force component F′ that tends to rotate the eccentric bush 26 around its center $O_5$ of shaft but it is considerably less than in the prior condition. The wrap 201 of the orbiting scroll 2 contacts and presses against the wrap 101 of the stationary scroll 1.

The above description demonstrates that in this invention, the wrap 201 of the orbiting scroll 2 is always pressed on the wrap 101 of the stationary scroll 2 to sufficiently seal it in a radial direction even though the scrolls may be incorrectly aligned due to inaccurate machining or assembly.

The pumping capacity of the scroll compressor based on this invention is increased because of the decrease of gas leakage from the compression pockets 3 and 5. Also, the pumping efficiency increases because of a reduction of load associated with recompressing whatever gas has leaked out.

While the value of eccentricity or orbiting radius R cannot be increased without restriction, the permissible orbiting radius R has sufficient range to cover the errors occurring in fabrication or assembly.

What is claimed is:

1. A scroll type positive fluid displacement apparatus comprising:

(a) a stationary scroll member (1) having a spiral-shaped wrap;

(b) an orbiting scroll member (2) having a spiral-shaped wrap of the same shape as that of said spiral wrap of said stationary scroll member but having a rotated orientation;

(c) a compression pocket (5) formed by a space between the wraps of said stationary scroll member and said orbiting scroll member;

(d) a driving shaft (14) eccentrically connected with said orbiting scroll member (2) for causing said orbiting scroll member to orbit;

(e) an eccentricity adjusting bushing (26) interposed between said orbiting scroll member and said driving shaft (14) and rotatable with respect to both said orbiting scroll member and said driving shaft;

(f) a bearing (17) mounted within the region radially enclosing said eccentricity adjusting bushing (26), for radially supporting said driving shaft and a connected portion (4) of said orbiting scroll member (2) which is connected with said driving shaft (14);

(g) a supporting member (10) supporting said bearing; and (h) rotation preventing means (11) for allowing orbital motion without rotation of said orbiting scroll member and said supporting member, whereby eccentricity between a center $O_1$ of said driving shaft (14) and a center $O_4$ of said connected portion (4) of said orbiting scroll member (2) being automatically adjusted by said driving shaft (14), said eccentricity adjusting bushing (26), and said connected portion (4) according to the rotation of said driving shaft (14) to cause said wrap (201) of said orbiting scroll member (2) to meet with said wrap (101) of said stationary scroll member (1) enough to seal therebetween.

2. A scroll type positive fluid displacement apparatus according to claim 1, wherein a moment operation on said driving shaft (4) is substantially zero, said moment being due to a reactive force $F_1$ induced in said bushing (26) and a reactive force $F_2$ induced in said bearing (17).

3. A scroll type positive fluid displacement apparatus according to claim 1, wherein said bearing (17) is longer than said bushing (26) in axial direction.

4. A scroll type positive fluid displacement apparatus according to claim 1, further comprising a first space (12) defined within said supporting member (10), and a coupling member (11) disposed in said first space (12) and moving in accordance with the rotation of said driving shaft (14) for causing said orbiting scroll member (2) to move in an orbiting motion, said first space (12) being disposed around said bearing (17).

5. A scroll type positive fluid displacement apparatus according to claim 4, wherein said stationary scroll member (1) is disposed vertically above said supporting member (10) said orbiting scroll member (2) is disposed between said stationary scroll member (1) and said supporting member (1), and said driving shaft (14) passes through said supporting member (10) and extended portion of said driving shaft extending vertically downwards from said supporting member (10).

6. A scroll type positive fluid displacement apparatus according to claim 5, further comprising a motor (19,20) a rotor (20) of which is mounted on said extended portion of said driving shaft (14), a second space (25) defined between said motor (19,20) and said supporting member (10), and an oil passage (13) passing downwardly through said supporting member (10) and connecting said first space (12) to said second space (25).

7. A scroll type positive fluid displacement apparatus according to claim 6, further comprising balancing means (21) mounted on said driving shaft (14) and disposed within said second space (25).

8. A scroll type positive fluid displacement apparatus according to claim 7, wherein said supporting member (1) and said motor (19,20) are within a sealed shell (23), said driving shaft (14) has an oil hole (15) formed therein, and an oil (24) reserved within a bottom portion of said shell (23) when said driving shaft (14) is rotated by said motor (19,20) is supplied to said bushing (26) through said oil hole (15) and said oil supplied to said bushing being supplied to said coupling member (11), and said oil supplied to said coupling member (11) falling down within said bottom portion of said shell (23) through said oil passage (13).

9. A scroll type positive fluid displacement apparatus comprising:

(a) a stationary scroll member (1) having a spiral-shaped wrap;

(b) an orbiting scroll member (2) having a spiral-shaped wrap of the same shape as that of said spiral wrap of said stationary scroll member but having a rotated orientation;

(c) a compression pocket (5) formed by a space between the wraps of said stationary scroll member and said orbiting scroll member;

(d) a driving shaft (14) having a first eccentric hole (16′) formed at its end with a predetermined eccentricity, causing said orbiting scroll member to orbit;

(e) an eccentric bushing (26) rotatably mounted in said first eccentric hole, having a second eccentric hole (16″) formed in said eccentric bushing with a predetermined eccentricity;

(f) a pin (4) formed on a surface of said orbiting scroll member on an opposite side to said spiral-shaped wrap of said orbiting scroll member, having an axis common with that of said orbiting scroll member and rotatably mounted in said second eccentric hole;

(g) a bearing (17) mounted within the region radially enclosing the bushing (26), for radially supporting said driving shaft;

(h) a supporting member (10) supporting said bearing; and (i) rotation preventing means (11) for allowing orbital motion without rotation of said orbiting scroll member and said supporting member.

10. A scroll type positive fluid displacement apparatus according to claim 1, wherein the material of said eccentric bushing is a bearing metal.

11. A scroll type positive fluid displacement apparatus according to claim 10, wherein said bearing (17) radially supports said pin (4) through said bushing (26) and said driving shaft (14).

12. A scroll type positive fluid displacement apparatus according to claim 10, wherein a moment operating on said driving shaft (14) is substantially zero, said moment being due to a reactive force $F_1$ induced in said bushing (26) and a reactive force $F_2$ induced in said bearing (17).

13. A scroll type positive fluid displacement apparatus according to claim 10, wherein a diameter of a portion of said driving shaft (14) containing said first eccentric hole (16') is larger than that of a remaining portion of said driving shaft (14).

14. A scroll type positive fluid displacement apparatus according to claim 10, wherein said bearing (17) is longer than said bushing (26) in an axial direction.

15. A scroll type positive fluid displacement apparatus according to claim 10, further comprising a thrust bearing (9) disposed between said orbiting scroll member (2) and said supporting member (10) and disposed radially outside of said driving shaft (14), said thrust bearing (9) axially supporting said orbiting scroll member (2).

16. A scroll type positive fluid displacement apparatus according to claim 15, wherein an end surface of said pin (4) is spaced in an axial direction from a bottom surface of said first hole (16'), and said driving shaft (14) and said bushing (26) are spaced in an axial direction from a base plate portion (3) of said orbiting scroll member (2).

17. A scroll type positive fluid displacement apparatus according to claim 15, further comprising a first space (12) within said supporting member (10), and a coupling member (11) disposed in said space (12) and moving in accordance with the rotation of said driving shaft (16) for causing said orbiting scroll member (2) to move in an orbiting motion, said first space (12) being disposed around said bearing (17) through a portion of said supporting member for said thrust bearing (9).

18. A scroll type positive fluid displacement apparatus according to claim 17, wherein said stationary scroll member (1) is disposed vertically above said supporting scroll member (10), said orbiting scroll member (2) is disposed between said stationary scroll member (1) and said supporting member (10), and said driving shaft (14) passes through said supporting member (10) and an extended portion of said driving shaft extends vertically downwards from said supporting member (10).

19. A scroll type positive fluid displacement apparatus according to claim 18, further comprising a motor (19, 20) a rotor (20) of which is mounted on said extended portion of said driving shaft (14), a second space (25) defined between said motor (19, 20) and said supporting member (10), and an oil passage (13) passing downwardly through said supporting member (10) and connecting said first space (12) to said second space (25).

20. A scroll type positive fluid displacement apparatus according to claim 19, further comprising balancing means (21) mounted on said driving shaft (14) and disposed within said second space (25).

21. A scroll type positive fluid displacement apparatus according to claim 20, wherein an intake tube (7) opens to an inlet pocket (6) located at a circumferential edge of said orbiting scroll member (2), said inlet pocket (6) is located vertically upward of said first space (12) and said oil passage (13), said fist space (12) is connected to said inlet pocket (6).

22. A scroll type positive fluid displacement apparatus according to claim 21, wherein said supporting member (10) and said motor (19,(20) are within a sealed shell (23), said driving shaft (14) has an oil hole (15) eccentrically formed therein, and an oil (24) reserved within a bottom portion of said shell (23) when said driving shaft (14) is rotated by said motor (19,20) is pumped up to said bushing (26) through said oil hole (15), said oil pumped up to said bushing being supplied to said coupling member (11) through said thrust bearing (9), and said oil supplied to said coupling member (11) falling down within said bottom portion of said shell (23) through said oil passage (13).

23. A scroll type positive fluid displacement apparatus comprising:

(a) a stationary scroll member (1) having a spiral-shaped wrap (101);

(b) an orbiting scroll member (2) having a spiral-shaped wrap (201) of the same shape as that of said spiral wrap of said stationary scroll member but having a rotated orientation;

(c) a compression pocket (5) formed by a space between the wraps of said stationary scroll member and said orbiting scroll member;

(d) a driving shaft (14) having a first eccentric hole (16') formed at its end with a predetermined eccentricity, causing said orbiting scroll member to orbit;

(e) a pin (4) formed on a surface of said orbiting scroll member on an opposite side to said spiral-shaped wrap of said orbiting scroll member, having an axis common with that of said orbiting scroll member;

(f) an eccentricity adjusting bushing (26) rotatably mounted in said first eccentric hole, having a second hole (16'') formed therein, said second hole (16'') enclosing and rotatably supporting said pin (4);

(g) a bearing (17) mounted within the region radially enclosing the bushing (26), for radially supporting said driving shaft and radially supporting said pin (4) through said bushing (26) and said driving shaft (14);

(h) a supporting member (10) supporting said bearing; and (i) rotation preventing means (11) for allowing orbital motion without rotation of said orbiting scroll member and said supporting member;

whereby eccentricity between a center $O_1$ of said driving shaft (14) and a center $O_4$ of said pin (4) is automatically adjusted by said driving shaft (14), said bushing (26) and said pin (4) according to the rotation of said driving shaft (14) to cause said wrap (201) of said orbiting scroll member (2) to meet with said wrap (101) of said stationary scroll.

24. A scroll type positive fluid displacement apparatus according to claim 23, wherein the material of said eccentric bushing is a bearing metal.

25. A scroll type positive fluid displacement apparatus according to claim 24, wherein said bearing (17) radially supports said pin (4) through said bushing (26) and said driving shaft (14).

26. A scroll type positive fluid displacement apparatus according to claim 24, wherein a moment operating on said driving shaft (14) is substantially zero, said moment being due to a reactive force $F_1$ induced in said bushing (26) and a reactive force $F_2$ induced in said bearing (17).

27. A scroll type positive fluid displacement apparatus according to claim 24, wherein a diameter of a portion of said driving shaft (14) containing said first hole (16') is larger than that of a remaining portion of said driving shaft (14).

28. A scroll type positive fluid displacement apparatus according to claim 24, wherein said bearing (17) is larger than said bushing (26) in an axial direction.

29. A scroll type positive fluid displacement apparatus according to claim 24, further comprising a thrust bearing (9) disposed between said orbiting scroll member (2) and said supporting member (10) and disposed radially outside of said driving shaft (14), said thrust bearing (9) axially supporting said orbiting scroll member (2).

30. A scroll type positive fluid displacement apparatus according to claim 29, wherein an end surface of said pin (4) is spaced in an axial direction from a bottom surface of said first hole (16'), and said driving shaft (14) and said bushing (26) are spaced in an axial direction from a base plate portion (3) of said orbiting scroll (2).

31. A scroll type positive fluid displacement apparatus according to claim 29, further comprising a first space (12) defined within said supporting member (10), and a coupling member (11) disposed in said first space (12) and moving in accordance with the rotation of said driving shaft (14) for causing said orbiting scroll member (2) to move in an orbiting motion, said space first (12) being disposed around said bearing (17) through a portion of said supporting member for said thrust bearing (9).

32. A scroll type positive fluid displacement apparatus according to claim 31, wherein said stationary scroll member (1) is disposed vertically above said supporting member (10), said orbiting scroll member (2) is disposed between said stationary scroll member (1) and said supporting member (10), and said driving shaft (14) passes through said supporting member (10) and an extending portion of said driving shaft extending vertically downwards from said supporting member (10).

33. A scroll type positive fluid displacement apparatus according to claim 12, further comprising a motor (19,20) a rotor (20) of which is mounted on said extended portion of said driving shaft (14), a second space (25) defined between said motor (19,20) and said supporting member (10), and an oil passage (13) passing vertically downwardly through said supporting member (10) and connecting said first space (12) to said second space (25).

34. A scroll type positive fluid displacement apparatus according to claim 33, further comprising a balancing means (21) mounted on said driving shaft (14) and disposed within said first space (25).

35. A scroll type positive fluid displacement apparatus according to claim 34, wherein an intake tube (7) opens to an inlet pocket (6) located at a circumferential edge of said orbiting scroll (2), said inlet pocket (6) is positioned vertically above said first space (12) and said oil passage (13), said first space (12) is connected to said inlet pocket (6).

36. A scroll type positive fluid displacement apparatus according to claim 35, wherein said supporting member (10) and said motor (19,20) are within a sealed shell (23), said driving shaft (14) has an oil hole (15) eccentrically formed therein, and an oil reserved within a bottom portion of said shell (23) when said driving shaft (14) is rotated by said motor (19,20) is pumped up to said bushing (26) through said oil hole (15), said oil pumped up to said bushing being supplied to said coupling member (11) through said thrust bearing (9), and said oil supplied to said coupling member (11) falling down within said bottom portion of said shell (23) through said oil passage (13).

* * * * *